US006726553B2

(12) United States Patent
Tiede et al.

(10) Patent No.: US 6,726,553 B2
(45) Date of Patent: Apr. 27, 2004

(54) MOTOR-POWERED PORTABLE GRINDING MACHINE

(75) Inventors: Steffen Tiede, Stuttgart (DE); Jorg Dehde, Steinenbronn (DE); Dieter Weninger, Steinenbronn (DE)

(73) Assignee: Robert Bosch GmbH, Stuggart (DE)

( * ) Notice: Subject to any disclaimer, the term of this patent is extended or adjusted under 35 U.S.C. 154(b) by 0 days.

(21) Appl. No.: 10/130,051

(22) PCT Filed: Aug. 2, 2001

(86) PCT No.: PCT/DE01/02944

§ 371 (c)(1),
(2), (4) Date: May 14, 2002

(87) PCT Pub. No.: WO02/24408

PCT Pub. Date: Mar. 28, 2002

(65) Prior Publication Data

US 2002/0193055 A1 Dec. 19, 2002

(30) Foreign Application Priority Data

Sep. 23, 2000 (DE) ..... 100 47 202

(51) Int. Cl.[7] ..... B24B 23/00
(52) U.S. Cl. ..... 451/357; 451/344
(58) Field of Search ..... 451/354, 344, 451/356–359, 524, 557

(56) References Cited

U.S. PATENT DOCUMENTS 5,453,040 A * 9/1995 Schaal et al. ..... 451/344
5,496,207 A * 3/1996 Hornung et al. ..... 451/357
5,580,302 A * 12/1996 Howard et al. ..... 451/357
5,595,531 A * 1/1997 Niemela et al. ..... 451/357
5,772,498 A * 6/1998 Neubert et al. ..... 451/357
5,807,169 A * 9/1998 Martin et al. ..... 451/357
5,830,047 A * 11/1998 McCracken ..... 451/357
5,888,128 A * 3/1999 Lamprecht et al. ..... 451/357
5,947,804 A * 9/1999 Fukinuki et al. ..... 451/357
6,394,884 B1 * 5/2002 Wuensch ..... 451/357

FOREIGN PATENT DOCUMENTS

| | | |
|---|---|---|
| DE | 199 52 108 A | 5/2001 |
| EP | 0 254 850 A | 2/1988 |
| EP | 0 573 916 A | 12/1993 |
| WO | 94 07654 A | 4/1994 |

* cited by examiner

*Primary Examiner*—Joseph J. Hail, III
*Assistant Examiner*—Anthony Ojini
(74) *Attorney, Agent, or Firm*—Michael J. Striker

(57) ABSTRACT

A motor-driven manual grinder (10), in particular an eccentric-plate grinder, has a work spindle (13) supported in the tool housing (11) and also has a grinding plate unit (15) that is driven and rotatable by the work spindle to execute an eccentric motion. The manual grinder (10) further has an annular first rolling face (28), extending together with the grinding plate unit (15) all the way around the eccentric axis (19), and an annular second rolling face (30), associated with the first, whose center axis extends coaxially to the central axis (17) of the work spindle (13), and on which the first rolling face (28) can roll. The second rolling face (30) is supported rotatably about its center axis. It is assigned a braking device (35), by means of which a rotation of the second rolling face (30) about its center axis can be selectively prevented for the forced-drive mode or enabled for the free-wheeling mode.

21 Claims, 7 Drawing Sheets

MOTOR-POWERED PORTABLE GRINDING MACHINE

PRIOR ART

The invention is based on a motor-driven manual grinder, in particular an eccentric-plate grinder.

A manual grinder of this type is known (European Patent Disclosure EP 0 245 850 A2), in which the first rolling face is embodied as an outer annular gear, which revolves with the driven grinding plate about the axis thereof, and in which the second rolling face is formed of an inner annular gear on an external crown gear, which is retained in a manner fixed against relative rotation with respect to the tool housing and is adjustable axially, by means of an external actuating device, between an inoperative position and a functional position that cooperates with the first rolling face. In the inoperative position, the second rolling face is out of engagement with the first rolling face. In the functional position, conversely, the second rolling face extends in approximately the same diametrically opposed plane as the first rolling face, so that in the revolution of the grinding plate the first rolling face can roll along the second rolling face, and thus a motion that rotates the grinding plate about its eccentric axis is superimposed on the eccentric motion of the grinding plate. As a result, when the second rolling face is in the functional position, enhanced abrasion of the workpiece is attainable. A disadvantage of this manual grinder is that the repositioning between idling and the forced-drive mode is not possible during operation of the manual grinder. In the axial relative motion, damage can occur to the teeth of both rolling faces. Another disadvantage, because of this arrangement of rolling faces, is a relatively great structural height of the grinder.

ADVANTAGES OF THE INVENTION

SUMMARY OF THE INVENTION

The motor-driven manual grinder of the invention, in particular an eccentric-plate grinder, has the advantage over the prior art that a switchover between the free-wheeling mode and the forced-entrainment mode is possible during operation of the manual grinder without the risk of damage, and the structural height is reduced at little expense for gearing.

By the provisions recited in the other claims, advantageous refinements of and improvements to the motor-driven manual grinder defined by claim 1 are possible.

In an advantageous embodiment, the braking device has an eccentric lever, actuatable by hand, for instance, that actuates the brake member and that has an eccentric element acting on the brake member.

The eccentric lever can be supported pivotably in the tool housing and as its eccentric element can have an eccentric peg that engages an opening, for instance a loop, on the end of the brake member, especially a brake band, which loops around the outer circumferential face of the external crown gear.

In another advantageous embodiment, the eccentric lever has a handle, located outside the tool housing, for pivoting actuation. Advantageously, the eccentric lever can be designed such that tensing the brake band is done by means of pivoting about a circumferential angle of about 180°. Thus the handle of the eccentric lever can easily be pivoted between two positions on traversing a circumferential angle of 180°, and thus the repositioning between the forced-drive mode and the free-wheeling mode can be done even during operation of the manual grinder.

In another advantageous embodiment of the invention, the outer annular gear is a part, in particular an integral part, of the grinding plate unit, for instance an integral component of the grinding plate itself, onto which the outer annular gear is injection-molded. This is especially simple and economical and furthermore contributes to reducing the structural height.

In still another advantageous embodiment, the inner annular gear of the external crown gear has a higher number of teeth than the outer annular gear. The difference in the number of teeth can for instance be 2. As a result, in the establishment of the forced-drive mode, the grinding plate can be driven at a thus-specified rpm. For instance, if the number of oscillations is 10,000, then for a ratio of the number of teeth of 50:48, the resultant rotary speed of a grinding plate in the forced-drive mode is 417 rpm.

In another advantageous embodiment, the grinding plate unit has a sleeve, coupled and in particular connected in a manner fixed against relative rotation to the work spindle and having an eccentric peg, for instance on its end, as well as a grinding plate retained on the peg by means of a bearing and connected detachably, for instance by means of a screw, to the eccentric peg.

It can also be advantageous if the outer annular gear has a bearing ring, axially spaced apart from the inner annular gear along the center axis, and is rotatably supported with the bearing ring by means of a bearing relative to the sleeve that is coaxial to the work spindle. The bearing can for instance be pressed onto the sleeve, and the external crown gear is pressed with its bearing ring onto the outer ring of the bearing.

In yet another advantageous embodiment, a fan wheel of an internal dust extractor is secured to the sleeve. Alternatively, the fan wheel can also be seated directly on the work spindle in a manner fixed against relative rotation and can have a sleeve that is eccentric to the spindle axis, with a cylindrical sleeve for terminal retention of the grinding plate being rotatably supported in the eccentric sleeve by means of a bearing.

In another advantageous embodiment, the sleeve with the eccentric peg on its end is formed of a sintered part and is thus designed especially economically. It can also be advantageous if the external crown gear is formed of a lightweight metal or zinc die-cast part, which once again makes for an economical design.

In another advantageous embodiment, the grinding plate, with the outer annular gear integral with it and forming the first rolling face, is formed of a one-piece injection-molded part, making for still further cost reduction and simplification.

Yet another advantageous embodiment provides that the brake member can be locked relative to the tool housing in a first position, in which it is in positive engagement with the second rolling face, and in a second position, in which it is not in any engagement with the second rolling face. It is especially advantageously possible as a result that the braking device is switchable between the first and second position and vice versa in all operating states, and in particular during idling, at a stop, and under load.

BACKGROUND OF THE INVENTION

It is especially advantageous if the brake member is a band, in particular a toothed belt, with a plurality of teeth which are able to enter into engagement with a crown gear of the second rolling face. Compared to purely frictional engagement, in this case no slip occurs between the braking device and the second rolling face. This prevents wear of the two parts meshing with one another and suppresses heat production.

It is especially advantageous if the brake member is embodied as an elastic band, in particular as a toothed belt. By means of such an elastic intermediate coupling, the switchover from the free-wheeling mode to the forced-entrainment mode can be made easily, with little tolerance.

Preferably, the brake member, in particular the elastic element, is connected to the tool housing at a fixation point such that it is rotatable about a fixed rotary axis. As a result, upon motion of the elastic element between the first and second positions, it is unnecessary to kink the elastic band, which means less wear.

It is advantageous if the braking device has a detent lever, which is connected to the tool housing via a spring element, especially if the spring element seeks to press the detent lever into a position in which the elastic element assumes its first position. Such a design is mechanically easy to achieve and is nevertheless sufficiently stable, so that incorrect operation will not occur.

It is also advantageous if the brake member is of spring-elastic material and has a first recessed region with a set of teeth, which can be brought into engagement with the outer circumferential face, and a second recessed region, and the brake member is held by prestressing in its first position and can be brought into its second position by an actuating device. It is possible as a result to use a simple part, such as a stamped part, as the brake member. This provides an economical embodiment. Moreover, by means of such a design, simple actuation is possible with an only slight actuating force. This embodiment simultaneously functions as an overload protection for the forced operating mode and as a cushion against rotational impact. It requires little space; in addition, it becomes possible to compensate for errors in pitch of the gear part, for instance caused by gear wear.

It is also advantageous if the detent lever is displaceable by means of an eccentric bolt, which is supported rotatably on the tool housing and is operable by means of the actuating device protruding from the tool housing. Thus the user can very easily switch over between the two positions of the elastic element without having to turn off the device, regardless of the operating state it is in at that particular time, that is both in the free-wheeling (fine grinding) mode and the forced-entrainment (coarse grinding) mode.

It is also advantageous if the fixation point and the eccentric bolt are essentially diametrically opposite one another relative to the central axis, and the angle between the fixation point and the teeth of the elastic element, which in the first position are in engagement with the second rolling face, is greater than 90°. This prevents overlooking under load.

It is furthermore advantageous if the fixation point and the eccentric bolt are essentially diametrically opposite one another relative to the central axis, and the cooperating faces of the brake member and of the second rolling face, under load, reinforce the retention force, similarly to a servo effect. Thus at little effort, a major retaining force is generated, which increases the reliability of the apparatus.

It is also advantageous if the braking device is switchable between the first and second position and vice versa in all operating states, and in particular during idling, at a stop, and under load. As a result, there is no need first to switch from one operating mode to another to enable switching between the first and second positions. This saves time and makes for greater ease of use for the user.

Further advantages and details of the invention are the subject of the dependent claims.

BRIEF DESCRIPTION OF THE DRAWINGS

The invention is described in further detail below in terms of two exemplary embodiments shown in the drawings. Shown are.

DESCRIPTION OF THE PREFERRED EMBODIMENT

Figure 1:
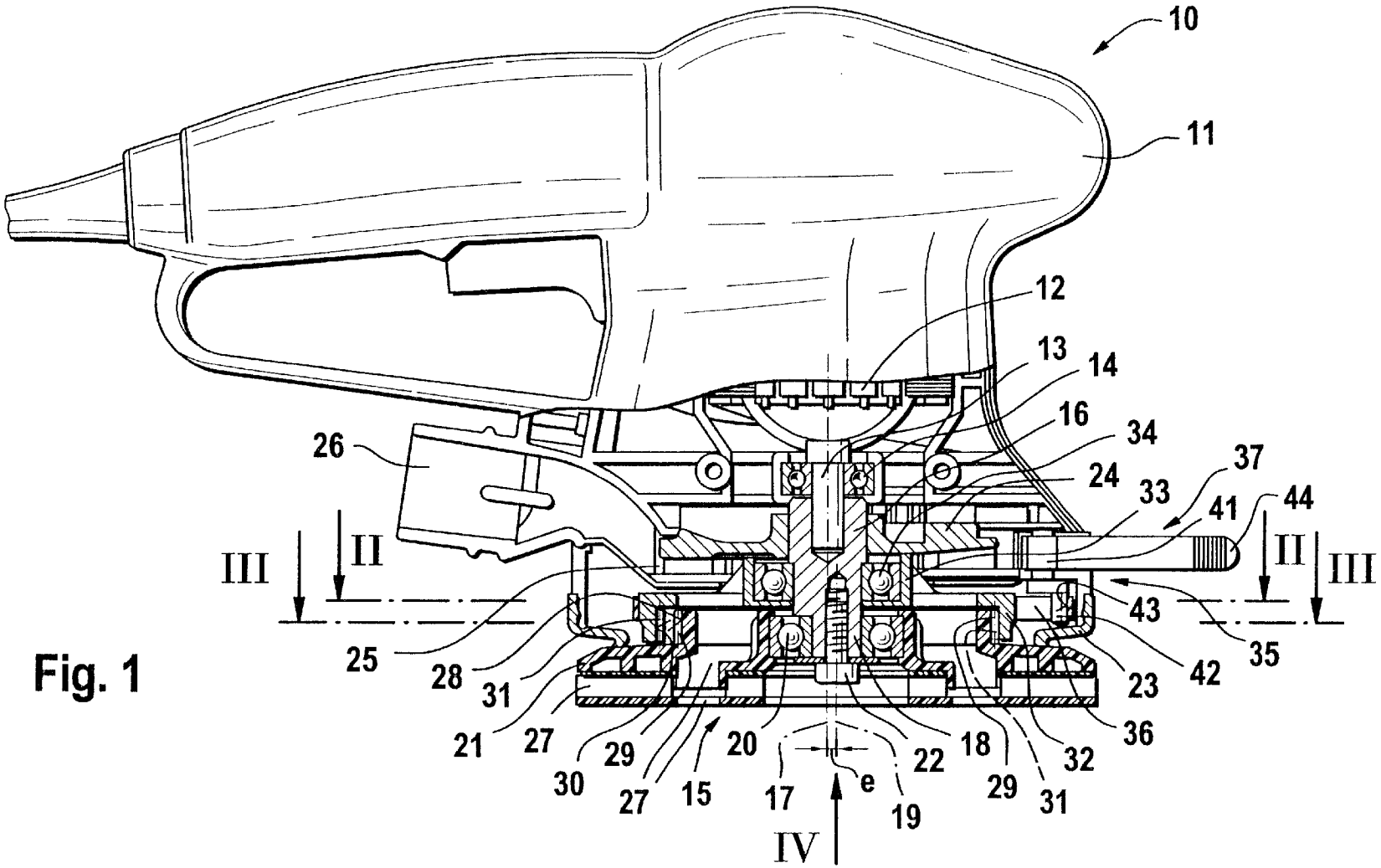
FIG. 1, a schematic section through a first exemplary embodiment of a manual grinder.

In FIG. 1, a first exemplary embodiment of a motor-driven manual grinder 10 is shown schematically; it is embodied here as an eccentric-plate grinder. The manual grinder 10 has a tool housing, identified overall by reference numeral 11, which includes an electric drive motor 12 with a work spindle 13 that is supported in the tool housing 11 by means of a bearing 14, for instance in the form of a ball bearing. A grinding plate unit identified overall by reference numeral 15 is connected to the work spindle 13 in a manner fixed against relative rotation; it is driven by the work spindle 13 to execute an eccentric motion and is rotatable. The grinding plate unit 15 has a sleeve 16, which is connected to the work spindle 13 axially and in a manner fixed against relative rotation. The sleeve 16 extends coaxially to the central axis 17 of the work spindle 13 and on its lower end, for instance, in FIG. 1 it has an eccentric peg 18, whose eccentric axis 19 extends with an eccentricity e to the central axis 17 and parallel to it. By means of a bearing 20, such as a ball bearing, a grinding plate 21 is rotatably supported on the eccentric peg 18. The grinding plate 21 is connected axially fixedly but rotatably to the sleeve 16 and the eccentric peg 19 by means of a screw 22 that is coaxial with the eccentric axis 19 and is screwed into the eccentric peg 18, and the grinding plate can be released again by loosening the screw 22. Between the tool housing 11 and the upper side, in terms of FIG. 1, of the grinding plate 21, there is a cuff 23 that seals off the intermediate space. The manual grinder 10 is equipped with an internal dust extractor, which includes a fan wheel 24 that is retained on the sleeve 16 in a manner fixed against relative rotation. The fan wheel 24 is located in a chamber 25, to which a dust extraction conduit 26 is connected. The grinding plate 21 is provided with conduits and/or openings 27 for the internal dust extraction.

The manual grinder 10 has an annular first rolling face 28, extending with the grinding plate unit 15 all the way around the eccentric axis 19; this face is embodied here as an outer annular gear 29. This outer annular gear 29 can, in an exemplary embodiment not shown, be an independent component, such as a gear wheel, that is connected to the sleeve 16 in a manner fixed against relative rotation. In the exemplary embodiment shown, the annular gear 29 is especially simply a part and in particular an integral part of the grinding plate unit 15, and in particular of the grinding plate 21, which in this integral design is advantageously formed of a plastic injection-molded part. Associated with the first rolling face 28 and in particular the outer annular gear 29 is an annular second rolling face 30, which encircles the first rolling face 28 and whose center axis extends coaxially to the central axis 17 of the work spindle 13. The first rolling face 28 can roll along the second rolling face 30 when the drive motor 12 has been switched on. The second rolling face 30 is advantageously embodied as an inner annular gear 31 of an external crown gear 32. The second rolling face 30, and in particular the external crown gear 32 that carries it, is rotatably supported about the central axis 17. In the first exemplary embodiment shown, the external crown gear 32 has a bearing ring 33 of smaller diameter, disposed along the central axis 17 and axially spaced apart from the inner annular gear 31; by way of this bearing ring, the external crown gear 32 is supported on the sleeve 16, rotatably relative to it, by means of a bearing 34, such as a ball bearing. The inner ring of the bearing 34 is connected to the sleeve 16 in a manner fixed against relative rotation, while the outer ring of the bearing 34 is connected to the bearing ring 33 and thus to the external crown gear 32 in a manner fixed against relative rotation.

A braking device identified overall by reference numeral 35 is associated with the second rolling face 30, and with it a rotation of the second rolling face 30 about its center axis, that is, about the central axis 17, can be selectively suppressed or enabled. The arrangement is such that the rotatability of the second rolling face 30, in particular of the external crown gear 32, can be suppressed or enabled during tool operation by means of the braking device 35.

The external crown gear 32 is designed as an integral component and advantageously comprises a lightweight metal die-cast part. The sleeve 16 with the eccentric peg 18 on its end is advantageously made from a sintered part.

In the first exemplary embodiment shown, the fan wheel 24 is disposed, as part of the internal dust extractor, in a manner fixed against relative rotation on the sleeve 16. In another exemplary embodiment, not shown, the fan wheel 24 is instead embodied on a fan sleeve, which is disposed on the work spindle 13 in a manner fixed against relative rotation and has an inner sleeve, which is eccentric to the central axis 17 and in which, by means of a bearing coaxial with the eccentric axis 19, a cylindrical sleeve similar to the sleeve 16 is retained rotatably and axially fixedly; the grinding plate 21 is releasably secured to its end by means of the screw 22.

The braking device 35 has a brake member 36, acting in braking fashion on the second rolling face 30, and an actuating device 37 for actuating the brake member 36. The brake member 36 is provided with a braking face 38, with which the brake member 36 can superficially engage an associated face 39 of the second rolling face 30 in order to block the second rolling face 30 from rotating; this face 39 is embodied in particular as an outer face of the external crown gear 32. The second rolling face 30 extends on the outside and encircles the first rolling face 28; both of them extend essentially within a common plane diametrically opposed to the central axis 17 of the work spindle 13. The face 39, designed as an outer face, of the second rolling face 30 in particular comprises the outer circumferential face 40 of the external crown gear 32.

The brake member 36 quite generally comprises a brake part of the kind that for blocking rotation can rest with its inside, embodied as a braking face 38, on the associated face 39 of the second rolling face 30, and in particular on the outer circumferential face 40 of the external crown gear 32. In an especially simple design, the brake member 36 comprises a brake band, which wraps around the outer circumferential face 40 of the external crown gear 32 and which can be tensed against the outer circumferential face 40 in order to block rotation.

The actuating device 37 has an eccentric lever, which has a central part 41, supported pivotably in the tool housing 11, and an eccentric peg 42 thereon, which engages an opening 43, such as a loop, on one end of the brake member 36 designed as a brake band. The central part 41 is engaged by a handle 44, located outside the tool housing 11, for the sake of pivoting actuation. This actuating device 37, in the form of an eccentric lever as explained, is designed such that tensing of the brake member 36, embodied as a brake band, is effected by means of pivoting of the central part 41 about a circumferential angle of approximately 180°. The tensed position, and thus the state of the external crown gear 32 in which it is blocked against rotation, is shown in FIG. 3. If the handle 44 is pivoted counterclockwise about 180° into the position shown in FIG. 2, then the brake member 36 in the form of the brake band is relaxed, so that the external crown gear 32 is not blocked, and its rotation about the central axis 17, which simultaneously represents its center axis, is therefore made possible.

In another exemplary embodiment, not shown, the actuating device 37 has a magnet, such as a controllable electromagnet, that actuates the brake member 36, for instance in the form of a brake band, and in particular that tenses the brake band.

Another special feature of the manual grinder 10 is that the inner annular gear 31 of the external crown gear 32 has a greater number of teeth than the outer annular gear 29. The difference in the number of teeth can for instance be two. This means that when the external crown gear 32 is braked, the outer annular gear 29 rolling along its inner annular gear 31 rotates onward by one tooth per 180° of eccentric motion, and thus with respect to the grinding plate 21 provided with the outer annular gear 29, a rotary speed of the grinding plate arises in the rolling process. For an assumed number of oscillations of 10,000 and with a ratio of the number of teeth of 50:48, the rotary speed of the grinding plate 21 is for instance 417 rpm.

If the braking device 35 is put in the braking position shown in FIG. 3 and if the drive motor 12 is turned on, then via this motor the drive spindle 13 and the sleeve 16, together with the fan wheel 24 and any balancing masses that may be present, not particularly shown here, are driven to rotate, for example at a speed of approximately 10,000 rpm. In the exemplary embodiment shown, the drive of the work spindle 13 is effected directly onto the sleeve 16. In another exemplary embodiment, not shown, a gear is instead connected between them. Because of this driving motion, the grinding plate 21 is driven in such a way that in addition to the eccentric motion, a rotation about the eccentric axis 19 takes place, the result of which is an eccentric rotary motion of the grinding plate 21. Because of the active braking device 35, the external crown gear 32 is prevented from rotating, so that upon revolving, the outer annular gear 29 can roll along the inner annular gear 31. In this stage, a forced-drive mode of the grinding plate 21 about the eccentric axis 19 as well is thus brought about.

Figure 2:
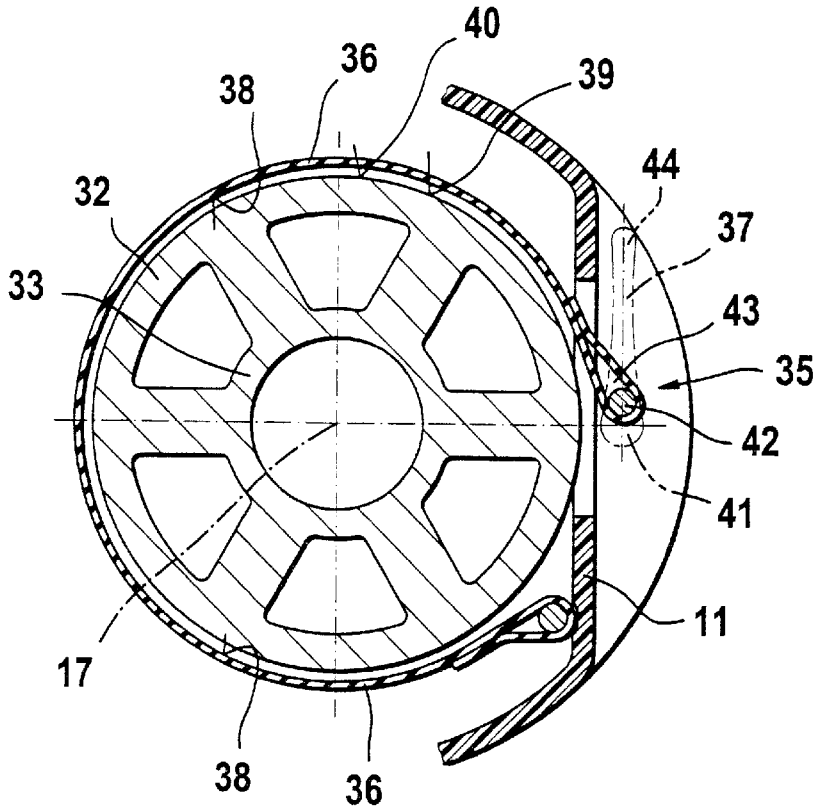
FIG. 2, a schematic plan view of parts of a braking device of the manual grinder in the plane II—II in FIG. 1.
Figure 3:
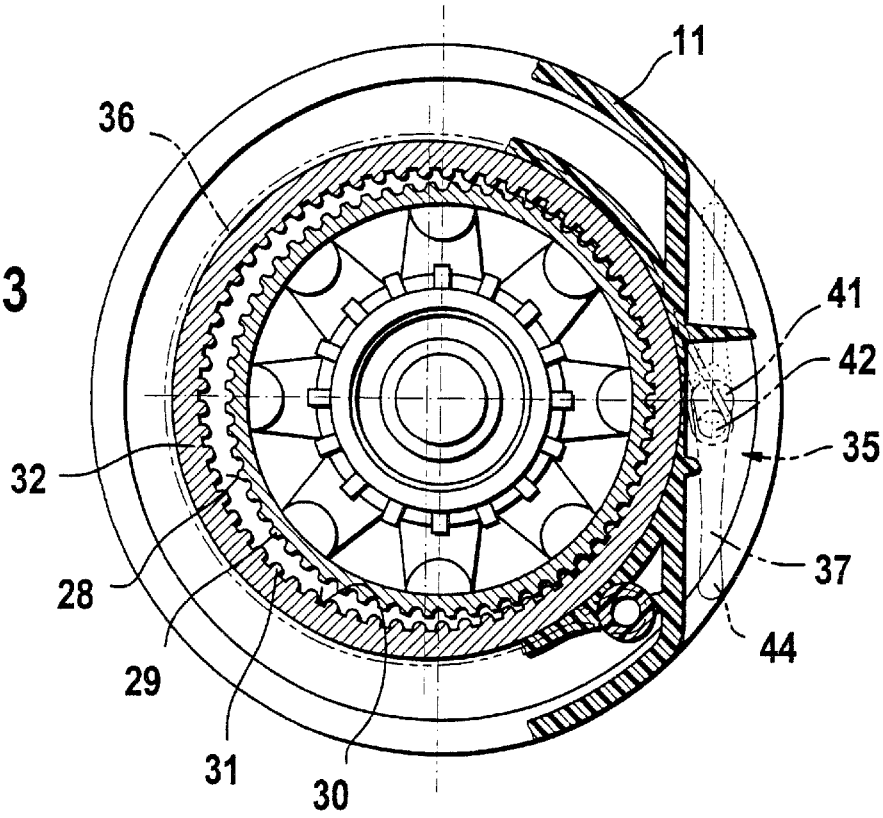
FIG. 3, a schematic fragmentary section taken along the line III—III in FIG. 1.
Figure 4:
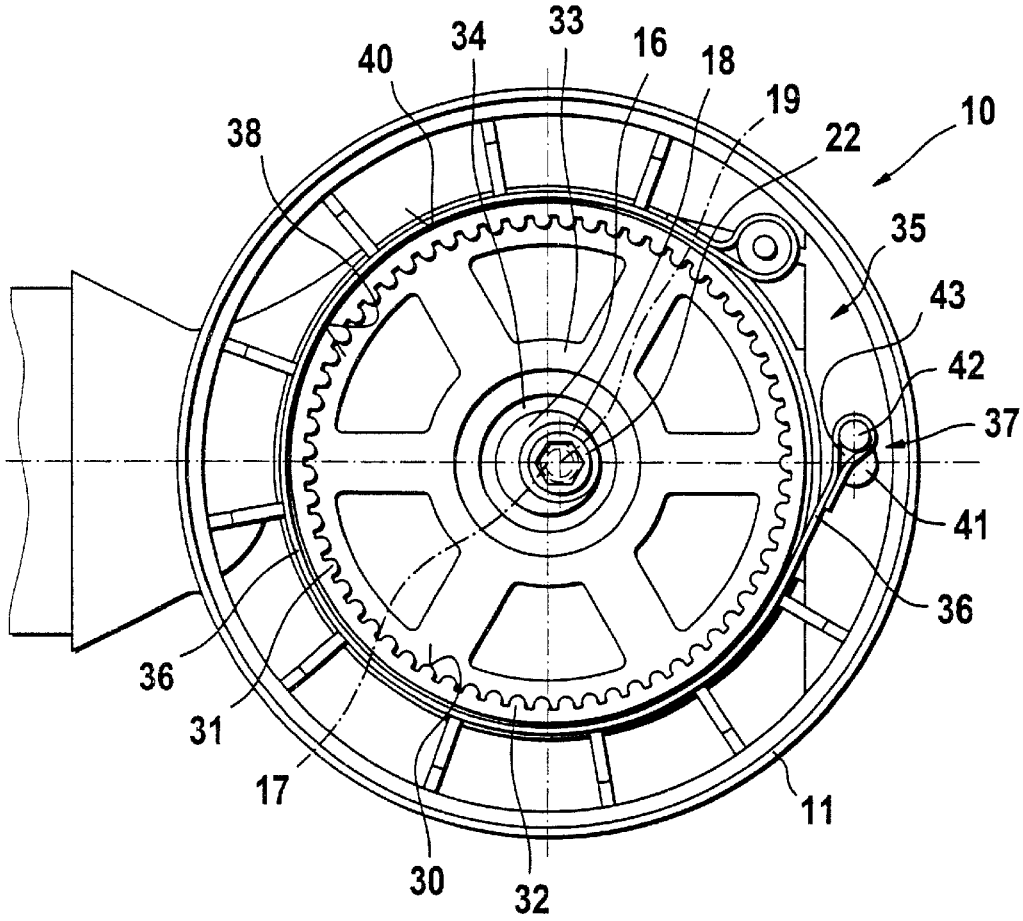
FIG. 4, a schematic view from below of parts of the manual grinder in the direction of the arrow IV in FIG. 1, without a grinding plate unit.

If during the operation of the manual grinder 10, the brake member 36 is now shifted to the non-braking state shown in FIG. 2 by means of the actuating device 37, then the external crown gear 32 is freely rotatable about the central axis 17, because of the support on the sleeve 16 by means of the bearing 34. The external crown gear 32 can now rotate as well, because of the friction in the bearing 34. Depending on the friction conditions, a relative motion of the external crown gear 32 occurs in the opposite direction of rotation from the grinding plate 21. The rotary speed of the grinding plate 21 is dependent on the load on the underlying support, that is, on how solidly the manual grinder 10 is pressed with the grinding plate 21, and a grinding blade releasably secured to it, for instance by means of a Velcro fastener, against a workpiece to be machined. Depending on given conditions, the rotary speed of the grinding plate 21 can also become zero. In that stage, the free-wheeling mode results for the manual grinder 10.

During the operation of the manual grinder 10 while it is switched on, a switchover from this free-wheeling mode to the forced-drive mode again can be made by actuation of the braking device 35.

The manual grinder 10 described is simple, compact, and economical. In a simple way, by lever actuation, or in another exemplary embodiment, not shown, by actuation of a magnet, a switchover to a continuous transition from the forced-entrainment mode to the free-wheeling mode is possible during tool operation. Because the outer annular gear 29 is injection-molded onto an annular part of the grinding plate 21 and is thus integral with it, the advantage is obtained of a reduced number of components and a lesser structural height. The little effort and expense needed to achieve the rolling gear, comprising the outer annular gear 29 and the inner annular gear 31, is also advantageous.

Figure 5:
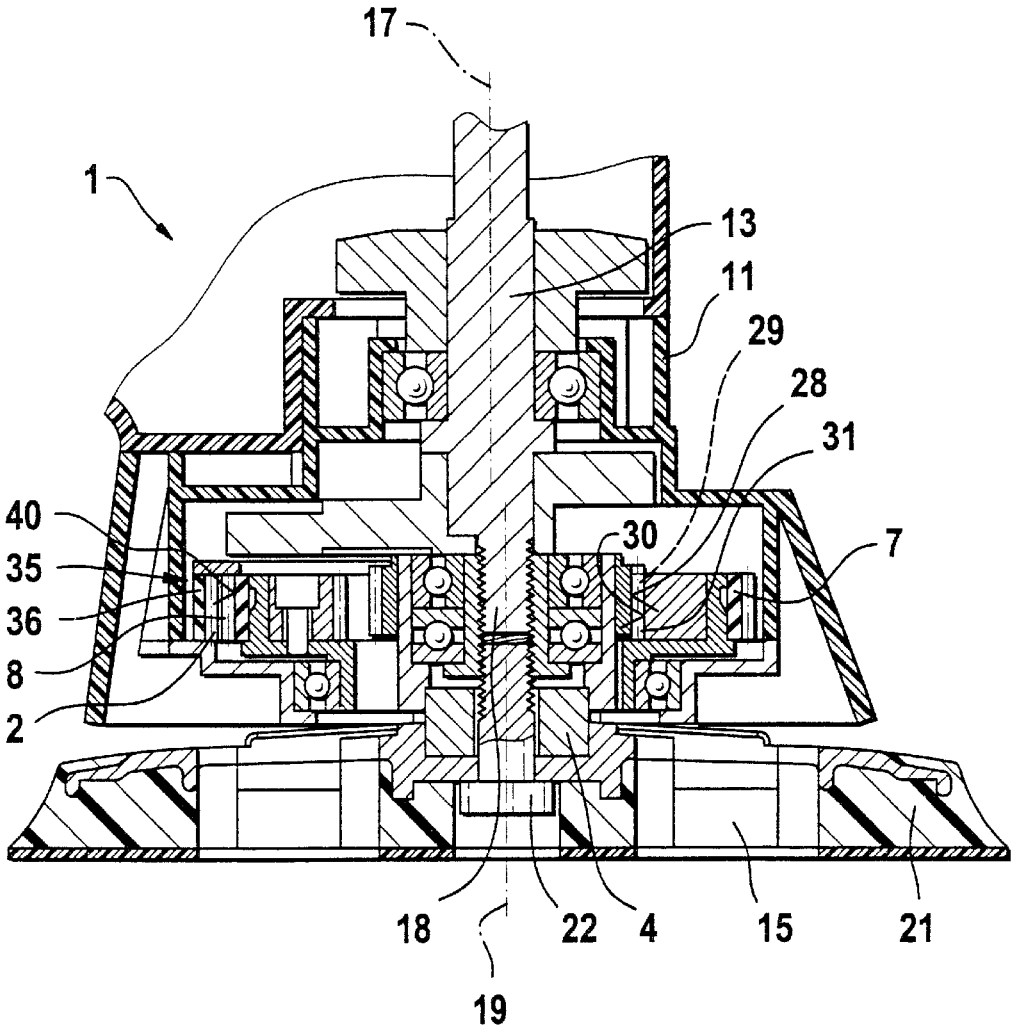
FIG. 5, a schematic section through a second exemplary embodiment of a manual grinder.

In FIG. 5, a second exemplary embodiment of a motor-driven manual grinder 10 is schematically shown. The drive of the grinding plate unit 15 and this grinding plate unit itself are in principle constructed identically to those of the first exemplary embodiment. A work spindle 13 is driven to rotate about a central axis 17 by a drive motor 12, not shown. On its power takeoff end, the work spindle 13 has an eccentric peg 18. This peg forms an eccentric axis 19. A first rolling face 28 is embodied concentrically about the eccentric axis 19, and with its outer annular gear 29 it engages an inner annular gear 31 of a second rolling face 30, which is arranged concentrically around the central axis 17. The grinding plate unit 15 is connected via a coaxial screw 22 to a power takeoff shaft 4, which is disposed coaxially about the eccentric axis 19. The parts described function like those of the first exemplary embodiment, so that reference is made to their description there.

Unlike the first exemplary embodiment, the outer circumferential face 40 of the second rolling face 30 is not embodied as essentially smooth but instead has a crown gear 8. The brake member 36 is embodied as an elastic element 7 and, in a distinction from the substantially smooth brake member 36 of the first exemplary embodiment, is provided with teeth 2, which are located opposite the crown gear 8.

Figure 6:
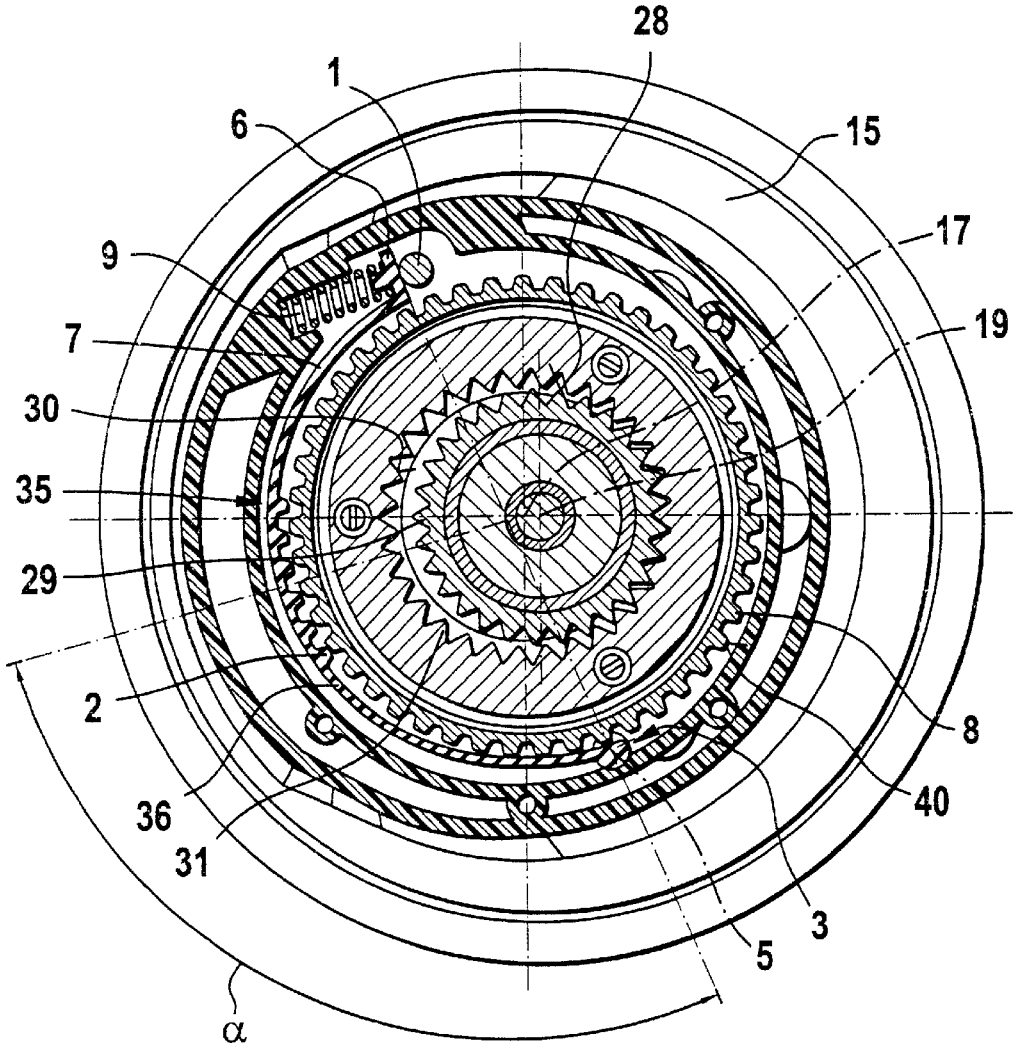
FIG. 6, a schematic section taken along the line A—A in FIG. 5, in which the braking device is not in engagement with the second rolling face.

In FIG. 6, the three-dimensional disposition between the teeth 2, which are embodied on the side of the elastic element 7 opposite the crown gear 8, is clearly shown. Here the elastic element 7 is in its second position, in which its teeth 2 are not meshing with the crown gear 8 of the second rolling face 30. As a result, the second rolling face 30 can run freely in this decoupled state. This means that the grinding plate 21 executes only an oscillating motion and a slight rotary motion, dependent on the bearing friction in the bearing 20. The manual grinder 10 is accordingly in the fine grinding mode. The greater the bearing friction, the more pronounced is the rotary motion. On one end, the elastic element 7 has a fixation point 3, which is connected to the tool housing 11 via a fixed rotary axis 5. On its other end, the elastic element 7 is embodied as a detent lever 6. The detent lever 6 is actuated by means of an eccentric bolt 1, which is connected to an actuating device 37 (not shown) of the kind in the first exemplary embodiment. The detent lever 6 is pressed constantly against the eccentric bolt 1 by a spring element 9, which is braced on the tool housing 11. The teeth 2 of the elastic element 7 are embodied closer to the detent lever 6 than to the fixation point 3. The fixation point 3 and the detent lever 6 are located essentially diametrically opposite the central axis 17. For the angle a between the fixation point 3 and the teeth 2, this means that the angle is greater than 90°. Not only does this prevent overlooking of the teeth 2 opposite the crown gear 8 under load, but it also enhances a retention force between the teeth 2 and the crown gear 8, in the manner of a servo effect.

Figure 7:
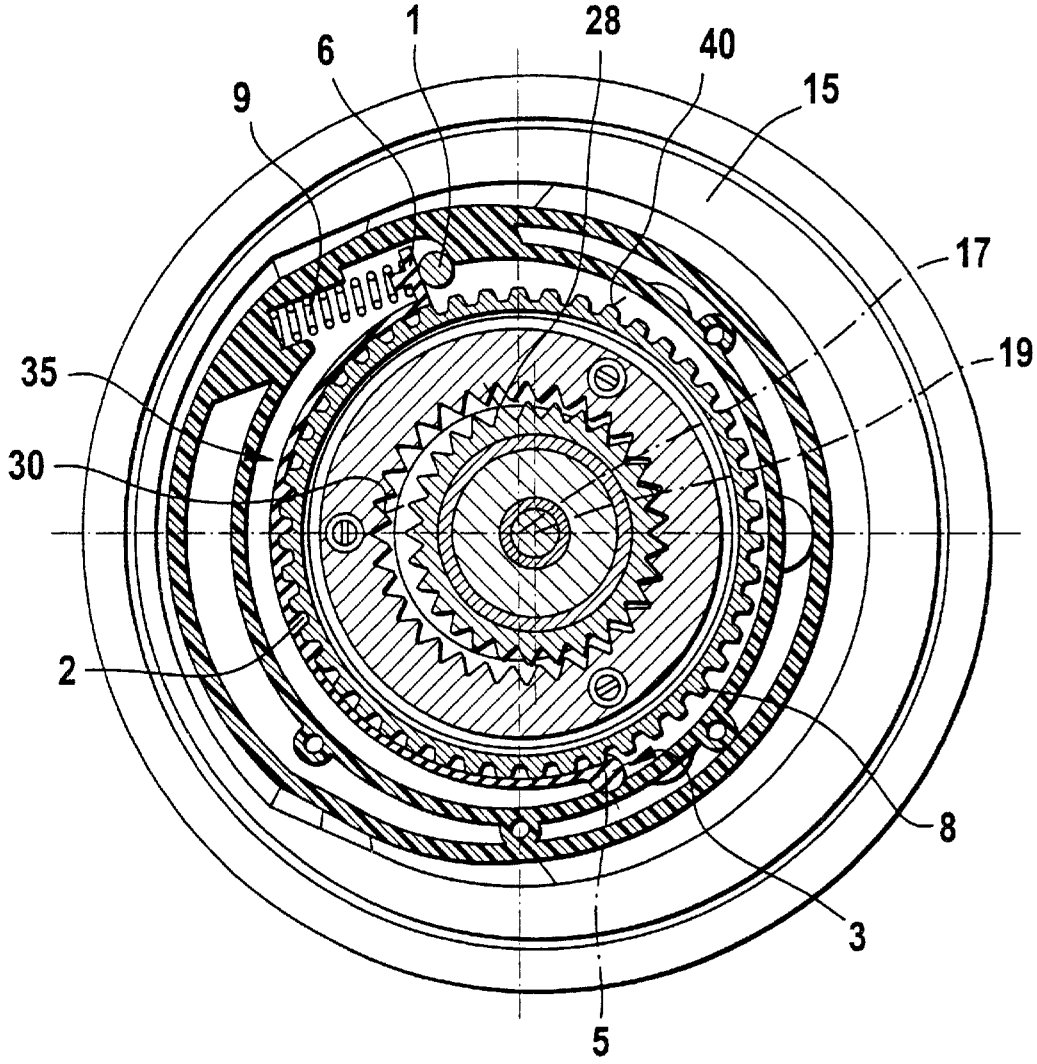
FIG. 7, a schematic section as in FIG. 6, with the braking device in engagement with the second rolling face.

In FIG. 7, the elastic element 7 is shown in its first position. The teeth 2 of the elastic element 7 engage the crown gear 8 on the outer circumferential face 40 of the second rolling face 30 by positive engagement. A forced entrainment is thus achieved, and the manual grinder 10 is operating in the coarse grinding mode. In that case, a rotary motion is imposed on the oscillating motion of the grinding plate 21. Because of the positive engagement between the teeth 2 and the crown gear 8, there is no slip between the braking device 35 and the second rolling face 30, and thus both wear and heat production tend toward zero. The engagement between the teeth 2 and the crown gear 8 is brought about, during the transition from the second position (FIG. 6) to the first position (FIG. 7), by providing that the eccentric bolt 1 is shifted, by the actuating device 37, not shown, from its position shown in FIG. 6 into its position shown in FIG. 7. For the motion of the eccentric bolt 1 from its position shown in FIG. 7 into its position shown in FIG. 6, the description made in conjunction with the first exemplary embodiment applies here as well. In the process, the spring element 9 presses the detent lever 6 constantly against the eccentric bolt 1. Since the one end of the elastic element 7 is supported rotatably about the fixed rotary axis 5, the elastic element 7 is brought closer to the second rolling face 30 before the positive engagement comes about. In the process, the eccentric bolt 1 is moved approximately 4° relative to the central axis 17.

The user thus has the capability of changing from the fine grinding mode to the coarse grinding mode via a switch lever, without having to turn off the tool. The switchover from free-wheeling to forced entrainment can be made, by means of an elastic intermediate coupling as described, in all operating states, that is, idling, at a stop, and under load. Moreover, the switchover is simple and involves little tolerance.

Figure 8:
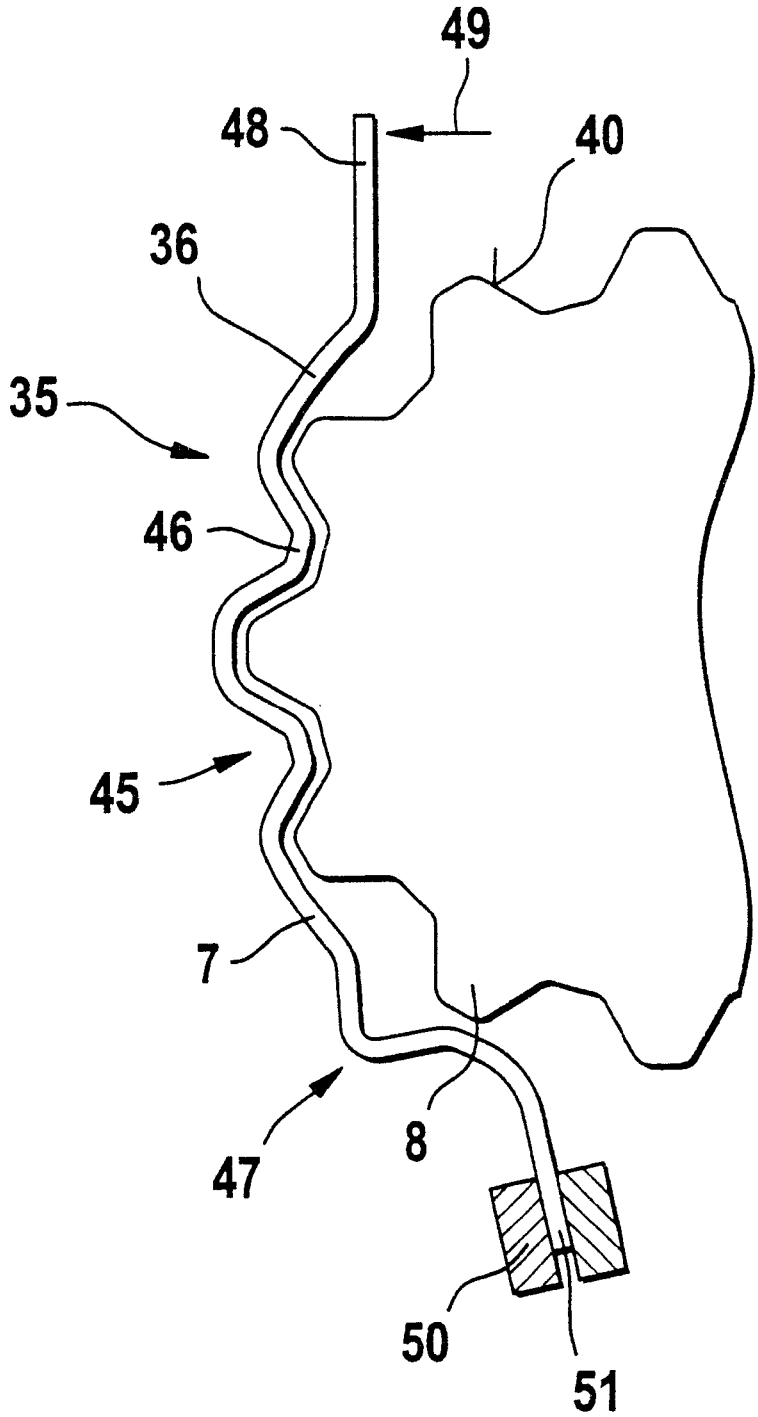
FIG. 8, a schematic fragmentary view of a third exemplary embodiment of a braking device.

In FIG. 8, the elastic element 7 is embodied in a version that is especially simple to realize. It is shown in its first position. The elastic element 7 is embodied as a shaped part of spring steel, which is essentially in the shape of a circular arc. On its first end 51, it is in a torsion spring joint 50, which is embodied rigidly with the tool housing (not shown). The elastic element 7 has a first recessed region 45, which is embodied as a set of teeth 46. In the exemplary embodiment shown, there are two teeth. However, only a single tooth and more than two teeth, for instance three or four teeth, are equally good options. The elastic element 7 is fastened in the torsion spring joint 50 in such a way that by its spring force, with its set of teeth 46, it presses against the crown gear 8 of the outer circumferential face 40 of the second rolling face 30. The crown gear 8 as a result snaps into the teeth 46 of the elastic element 7. This positive-engagement connection can be undone by exerting a force 49 on the second end 48 of the elastic element 7, which force undoes the locking by moving the teeth 46 away from the crown gear 8. This is accomplished counter to the spring force of the elastic element 7, because of its fastening in the torsion spring joint 50. Besides the first recessed region 45, the elastic element 7 has a second recessed region 47. This second recessed region 47 has a tangential elasticity and thus serves as a rotary impact cushion.

Such a design of the braking device 35 is very simple and economical. It can be actuated very simply, with the expenditure of only slight actuating force, and furthermore has a rotary impact cushion and an overload protection for the forced operating mode. Besides the advantage of requiring little space, it allows compensating for errors in pitch of the gear part, caused for instance by wear.

| List of Reference Numerals | |
|---|---|
| 1 | Eccentric bolt |
| 2 | Teeth |
| 3 | Fixation point |
| 4 | Power takeoff shaft |
| 5 | Fixed rotary axis |
| 6 | Detent lever |
| 7 | Elastic element |
| 8 | crown gear |
| 9 | Spring element |
| 10 | Manual grinder |
| 11 | Tool housing |
| 12 | Drive motor |
| 13 | Drive spindle |
| 14 | Bearing |
| 15 | Grinding plate unit |
| 16 | Sleeve |
| 17 | Central axis |
| 18 | Eccentric peg |
| 19 | Eccentric axis |
| 20 | Bearing |
| 21 | Grinding plate |
| 22 | Coaxial screw |
| 23 | Cuff |
| 24 | Fan wheel |
| 25 | Chamber |
| 26 | Dust extraction conduit |
| 27 | opening |
| 28 | First rolling face |
| 29 | Outer annular gear |
| 30 | Second rolling face |
| 31 | Inner annular gear |
| 32 | External crown gear |
| 33 | Bearing ring |
| 34 | Bearing |
| 35 | Braking device |
| 36 | Brake member |
| 37 | Actuating device |
| 38 | Braking face |
| 39 | Face |
| 40 | Outer circumferential face |
| 41 | Central part |
| 42 | Eccentric peg |
| 43 | Opening |
| 44 | Handle |
| 45 | First recessed region |
| 46 | Set of teeth |

-continued

| List of Reference Numerals | |
|---|---|
| 47 | Second recessed region |
| 48 | Second end |
| 49 | Force |
| 50 | Torsion spring joint |
| 51 | First end |

What is claimed is:

1. A motor-driven manual grinder, in particular an eccentric-plate grinder, comprising a work spindle (13) supported in a tool housing (11) and having a central axis (17), a grinding plate unit (15) driven and rotatable by the work spindle to execute an eccentric motion, an annular first rolling face (28) extending together with the grinding plate unit (15) all the way around an eccentric axis (19), and an annular second rolling face (30) associated with the first rolling face (28), whose center axis extends coaxially to the central axis (17) of the work spindle (13) and on which the first rolling face (28) can roll, characterized in that the second rolling face (30) is supported, rotatable about the central axis (17), in a bearing (34), and that a braking device (35) is associated with the second rolling face (30), by means of which a rotation of the second rolling face (30) about the central axis (17) can be selectively prevented for forced drive mode and/or enabled for free wheeling mode.

2. The motor-driven manual grinder of claim 1, characterized in that the rotatability of the second rolling face (30) can be prevented or enabled by the braking device (35) during tool operation.

3. The motor-driven manual grinder of claim 1, characterized in that the braking device (35) has a brake member (36), acting in braking fashion on the second rolling face (30), and an actuating device (37) for actuating the brake member (36).

4. The motor-driven manual grinder of claim 1, characterized in that the brake member (36) has a braking face (38), with which the brake member (36) can superficially engage an associated face (39) of the second rolling face (30), especially an outer face, in order to block the second rolling face (30).

5. The motor-driven manual grinder of claim 1, characterized in that the second rolling face (30) extends on the outside and encircles the first rolling face (28), and that both rolling faces (28, 30) extend essentially inside a common plane diametrically opposed to the axis (17) of the work spindle (13).

6. The motor-driven manual grinder of claim 1, characterized in that the second rolling face (30) is embodied as an inner annular gear (31) of an external crown gear (32), and the first rolling face (28) is embodied as an outer annular gear (29).

7. The motor-driven manual grinder of claim 1, characterized in that an outer face, in particular an outer circumferential face (40) of the second rolling face (30), in particular of the external crown gear (32), is embodied as a face that cooperates with the brake member (36) to block rotation.

8. The motor-driven manual grinder of claim 7, characterized in that the brake member (36) of the braking device (35) can rest with an inside face, embodied as a braking face (38), on the associated face (39), in particular on the outer circumferential face (40) of the external crown gear (32), to block rotation.

9. The motor-driven manual grinder of claim 1, characterized in that the actuating device (37) has a magnet, in particular a controllable electromagnet, that actuates the brake member (36), or has an eccentric lever, which for instance is manually actuatable, with an eccentric element (42) acting on the brake member (36).

10. The motor-driven manual grinder of claim 1, characterized In that the brake member (36) is formed of a brake band, which for blocking rotation can be tensed against the face (39), in particular the outer circumferential face (40) of the external crown gear (32).

11. The motor-driven manual grinder of claim 1, characterized in that the brake member (36) can be locked relative to the tool housing (11), in a first position, in which it is in positive engagement with the second rolling face (30), and in a second position, In which it is not in any engagement with the second rolling face (30).

12. The motor-driven manual grinder of claim 11, characterized in that the brake member (36) is a band, in particular a toothed belt, with a plurality of teeth (2) which are able to enter into engagement with a crown gear (8) of the second rolling face (30).

13. The motor-driven manual grinder of claim 12, characterized in that the brake member (36) is embodied as an elastic element (7), i particular as a toothed belt.

14. The motor-driven manual grinder of claim 11, characterized in that the brake member (36), in particular the elastic element (7), is connected to the tool housing (11) at a fixation point (8) such that it is rotatable about a fixed rotary axis (5).

15. The motor-driven manual grinder claim 14, characterized in that the fixation point (3) and the eccentric bolt (1) are essentially diametrically opposite one another relative to the central axis (17), and the angle ($\alpha$) between the fixation point (3) and the teeth (2) of the elastic element (7), which in the first position are in engagement with the second rolling face (39), is greater than 90°.

16. The motor-driven manual grinder of claim 14, characterized in that the fixation point (3) and the eccentric bolt (1) are essentially diametrically opposite one another relative to the central axis (17), and the cooperating faces of the brake member (36) and of the second rolling face (30), under load, reinforce the retention force, in a manner similar to a servo effect.

17. The motor-driven manual grinder claims 11, characterized in that the braking device (35) has a detent lever (6), which is connected to the tool housing (11) via a spring element (9).

18. The motor-driven manual grinder of claim 17, characterized in that the spring element (9) seeks to press the detent lever (6) Into a position in which the elastic element (7) assumes its first position.

19. The motor-driven manual grinder claim 11, characterized in that the brake member (36) is of spring-elastic material and has a first recessed region (45) with a set of teeth (46) which can be brought into engagement with the outer circumferential face (40), and a second recessed region (47), and the brake member (36) is held by prestressing in its first position and can be brought into its second position by an actuating device (37).

20. The motor-driven manual grinder claim 11, characterized in that the detent lever (6) is displaceable by means of an eccentric bolt (1), which is supported rotatably on the tool housing (11) and is operable by means of the actuating device (37) protruding from the tool housing (11).

21. The motor-driven manual grinder claim 11, characterized in that the braking device (35) is switchable between the first and second position and vice versa in all operating states, and in particular during idling, at a stop, and under load.

* * * * *